US005919040A

United States Patent [19]

Brakemeier

[11] Patent Number: 5,919,040

[45] Date of Patent: Jul. 6, 1999

[54] KILN, ESPECIALLY FOR CERAMIC PRODUCTS

[76] Inventor: Karl-Heinz Brakemeier, Am Hettberg 5, D-31249 Hohenhameln, Germany

[21] Appl. No.: 08/924,355

[22] Filed: Sep. 5, 1997

[30] Foreign Application Priority Data

Sep. 5, 1996 [DE] Germany ..... 196 35 991

[51] Int. Cl.[6] ..... F27B 9/26; F27D 3/12

[52] U.S. Cl. ..... 432/241; 432/137; 432/243

[58] Field of Search ..... 432/241, 128, 432/230, 243, 258

[56] References Cited

U.S. PATENT DOCUMENTS

| | | | |
|---|---|---|---|
| 2,974,387 | 3/1961 | Tomkins | 432/258 |
| 4,408,987 | 10/1983 | Oyler | 432/137 |
| 4,609,345 | 9/1986 | Schroder et al. | 432/137 |
| 5,006,063 | 4/1991 | Poggi et al. | 432/241 |
| 5,529,488 | 6/1996 | Jensen | 432/241 |

FOREIGN PATENT DOCUMENTS

| | | |
|---|---|---|
| 4130437 | 3/1993 | Germany . |
| 9727440 | 7/1997 | WIPO . |

*Primary Examiner*—Teresa Walberg
*Assistant Examiner*—Gregory A. Wilson
*Attorney, Agent, or Firm*—Robert W. Becker & Associates

[57] ABSTRACT

A kiln for ceramic products has a firing chamber including sidewalls with opposed slots. A transport device for transporting the ceramic products through the firing chamber in a transport direction is provided. The transport device includes rods for supporting the ceramic products. The rods extend perpendicularly to the transport direction and penetrate the opposed slots. The transport device includes a rail system and holders movably guided on the rail system. The rods have a first and second ends supported by a first and second sets of holders and a second set of holders. The first and second sets of holders are respectively detachably connected to one another. The holders within the opposed slots are arranged directly adjacent to one another to tightly seal the slots. The firing chamber has an upstream end and a downstream end in the transport direction. The holders, with the rods supported thereon, are detached from one another at the downstream end and are transported back to the upstream end at a transport velocity greater than the transport velocity in the firing chamber. They are reconnected to the holders present at the upstream end for transport through the firing chamber.

14 Claims, 3 Drawing Sheets

KILN, ESPECIALLY FOR CERAMIC PRODUCTS

BACKGROUND OF THE INVENTION

The invention relates to a kiln, especially for ceramic products, in which the material products to be fired are transported by a transporting device through a channel-shaped firing chamber whereby the transport device has rods for receiving the material to be fired which extend perpendicular to the transport direction of the transport device. Slots are provided in the sidewalls of the firing chamber and are penetrated by the transversely extending rods, whereby the rods are supported by holders that are connected to one another and guided on a rail system. Within the slot area the holders are arranged directly adjacent to one another so that the slots are sealed.

Such kilns are known from German Offenlegungsschrift 41 30 437; however, this device includes a continuous, circulating transport device which comprises within the working side as well as within the return side holders with the transverse rods. This means that the kiln must comprise a correspondingly large amount of holders and, in particular, must include a large number of transverse rods. This results in a high purchase price for this device.

It therefore an object of the present invention to eliminate these disadvantages and to improve the device such that the number of holders as well as the number of rods supported thereby is reduced.

SUMMARY OF THE INVENTION

The inventive kiln for ceramic products according to the present invention comprises the following features:

A firing chamber having sidewalls with opposed slots;

A transport device for transporting the ceramic products through the firing chamber in a transport direction;

The transport device comprising rods for supporting the ceramic product;

The rods extending perpendicularly to the transport direction and penetrating the opposed slots;

The transport device comprising a rail system and holders movably guided on the rail system;

The rods having a first and a second end supported by a first set of holders and a second set of holders; respectively;

The first set of holders detachably connected to one another and the second set of holders detachably connected to one another, wherein the holders within the opposed slots are arranged directly adjacent to one another to tightly seal the slots;

Wherein the firing chamber has an upstream end and a downstream end in the transport direction;

Wherein the holders, with the rods supported thereon are detached, from one another at the downstream end and are transported back to the upstream end at a transport velocity greater than a transport velocity in the firing chamber and are reconnected to the holders present at the upstream end for transport through the firing chamber.

Advantageously, the holders are moved stepwise in advancing steps within the firing chamber.

Advantageously, the travel length of the advancing steps matches the length of the holders.

Preferably, the travel length of the advancing steps matches the length of the ceramic product.

The travel length of the advancing steps may match the spacing between the rods.

Advantageously, the transport device comprises a towing transporter for transporting the holders from the downstream end back to the upstream end.

Preferably, the towing transporter transports the holders in a stepwise manner.

Advantageously, the holders are connected to one another by a hook connection or a pin connection.

The hook connection is preferably embodied such that the hook connection is coupled or decoupled when the holders are positioned in a slanted position relative to one another.

The hook connection may comprise a hook pivotable about a pivot axis extending perpendicularly to the support direction and wherein the holders are moved into the slanted position by contacting a stationary cam of the transport device.

Advantageously, in the slanted position the holders are positioned at an angle of 20° to 40° to one another.

Advantageously, the pin connection comprises a pin extending perpendicularly to the transport direction and the pin connection is released by a relative movement of the holders in a direction transverse to the transport direction.

The transport device preferably comprises carriages to which the holders are connected. The rods are positioned above the carriages during transport from the downstream end to the upstream end.

Advantageously, each one of the holders supports two rods.

According to the present invention, at the downstream end of the firing chamber the holders supporting the rods are detached from one another and are then transported, in comparison to the transport velocity within the firing chamber, at an increased velocity to the upstream end of the firing chamber where they are reconnected to the holders already present within the working side of the transport device entering the firing chamber.

Accordingly, a continuous, circulating transporting device is obsolete and the holders must no longer be transported tightly adjacent to one another. Instead, they are individualized on the travel path from the downstream end of the firing chamber to the upstream end and are transported at a greater velocity to the entrance into the combustion chamber. In order to facilitate removal of the holders at the downstream end, the holders are guided in a step-wise manner within the working side of the transport device whereby, beginning at the downstream end of the firing chamber, they are moved as pulled (towed) elements and must therefore be connected in a pull-resistant manner.

While the holders within the working side of the transport device are guided in a step-wise manner, the return of the holders from the downstream end to the upstream end of the firing chamber, can be performed by being entrained by a circulating transporting device, i.e., in the form of a towing transporter.

In order to be able to add or remove holders, they are detachably secured to one another. This is preferably realized with a hook connection or pin connection in order to provide a pull-resistant connection between two adjacently arranged holders within the working side of the transport device.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
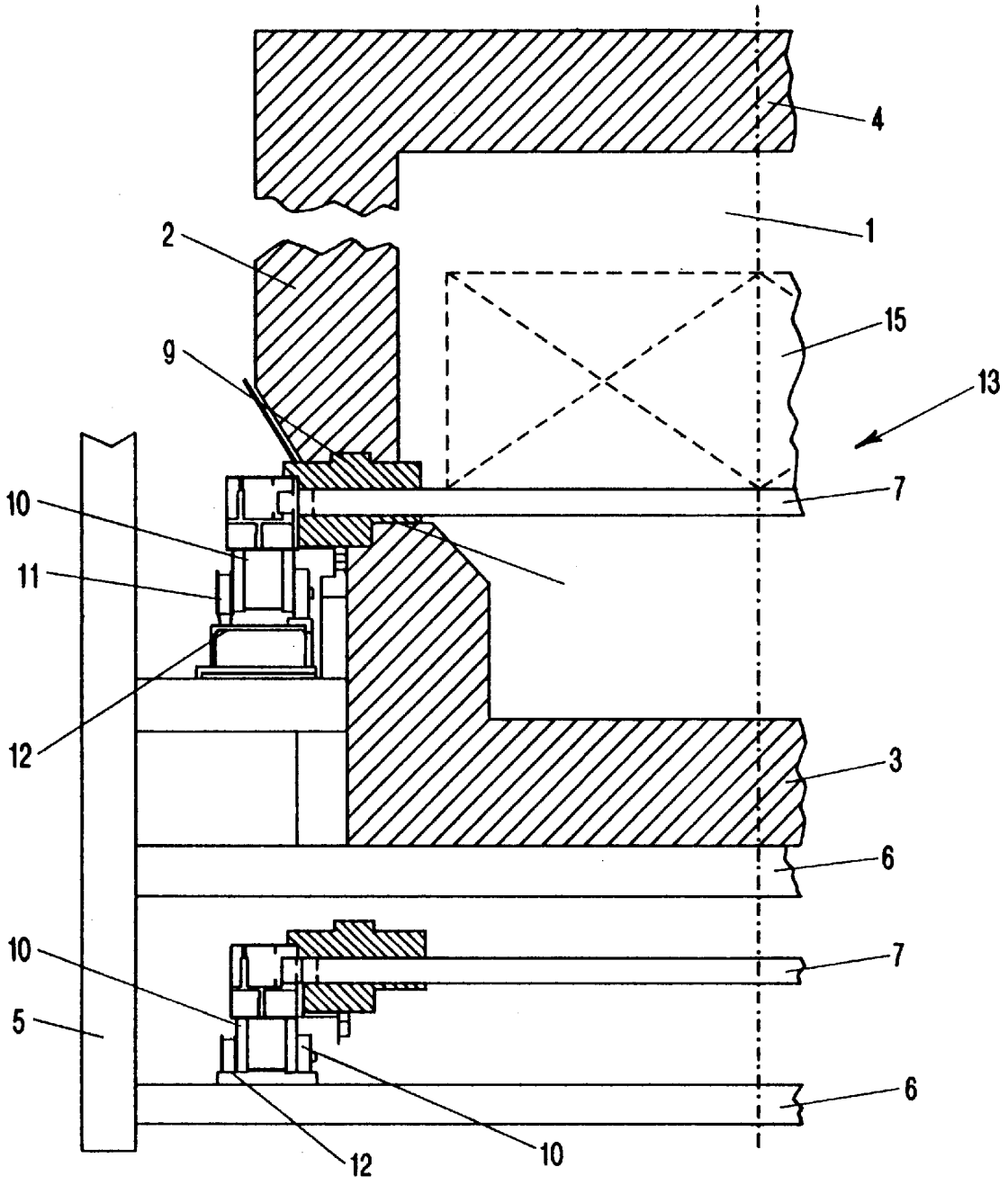
FIG. 1 is a vertical cross-section of the kiln for ceramic products, showing the left half of the kiln.

The present invention will now be described in detail with the aid of a specific embodiment utilizing FIGS. 1 through 5.

In a manner known per se the firing chamber 1 has side walls 2, a bottom 3, and a cover 4. These components are produced primarily of heat-insulating material. For supporting the firing chamber, a steel frame having supports 5 and transverse stays 6 is provided.

Rods 7 are provided which extend horizontally and at a small distance to one another which penetrate the lower portion of the firing chamber 1 and also a respective slot 8 within the sidewalls 2. The rods 7 are hollow square rods of a heat-resistant material and are substantially bending resistant.

The ends of the rods 7 are positioned externally to the sidewalls 2 and are positioned thereat on block-shaped holders 9 which are connected to a carriage-like frame 10. The respective carriage wheels 11 are guided on the rails 12 of the working side of the transport device. Below the firing chamber 1 the idle return side 14 of the transport device is positional including the respective rail system 12.

Figure 2:
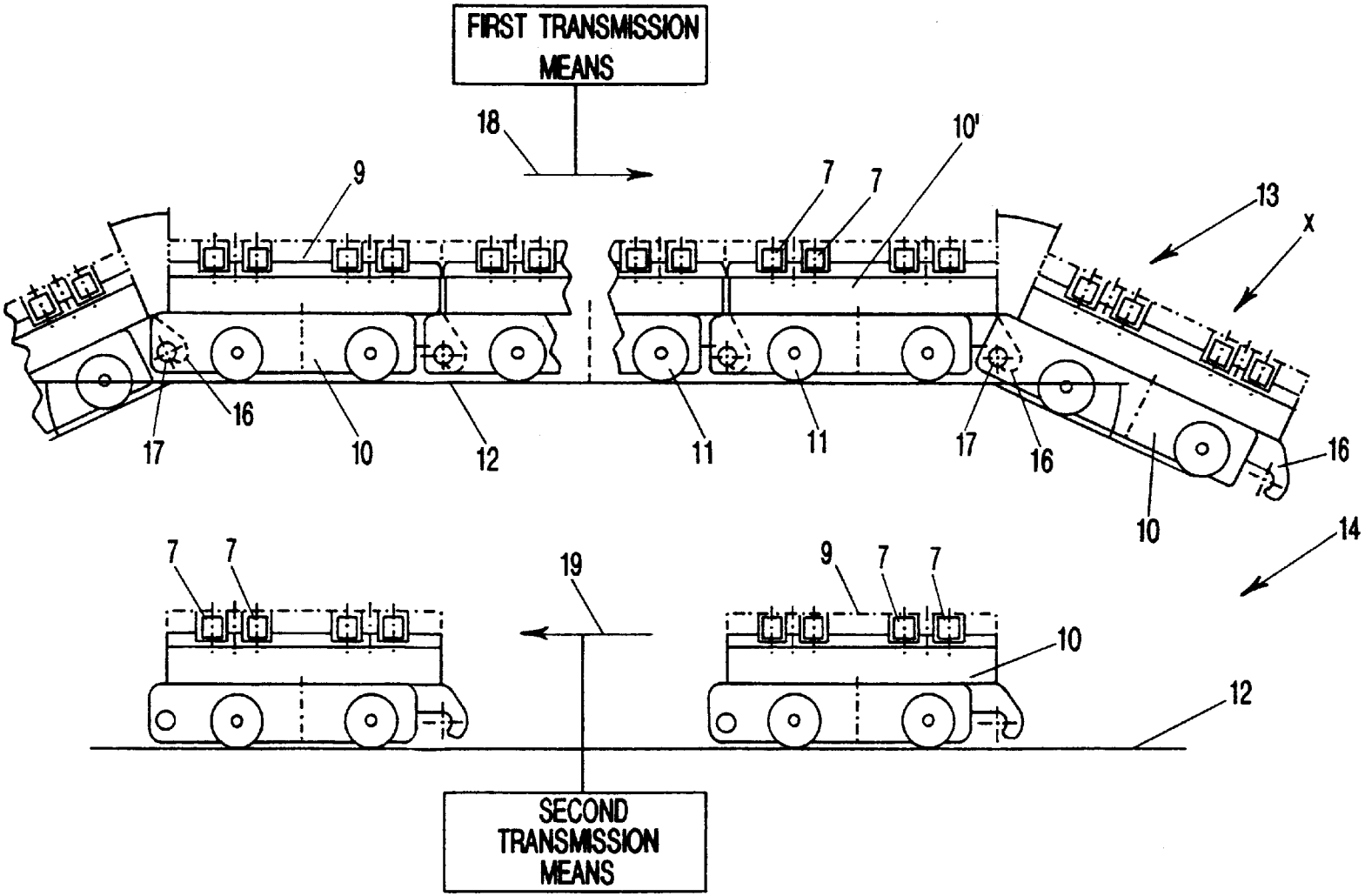
FIG. 2 shows guiding of the holders with coordinated rods within the firing chamber (working side of the transport device) and below the firing chamber in a return flow (return side of the transport device)

As can be seen in FIG. 2, upper half, the holders 9 are positioned tightly adjacent to one another. As can be seen furthermore in FIG. 1, the holders 9 have such a shape that they can fill the slots 8 in order to provide a sufficient slot sealing action.

The ceramic products to be fired within the firing chamber 1 are transported on the rods 7 through the firing chamber whereby it is especially advantageous that each holder 9 supports two pairs of rods 7. Optionally further rods 7 may be supported thereat. Also, rods 7 that are not paired may be supported thereat. At the leading end of the frame (carriage) 10 in the transport direction, hooks 16 are provided which are engaged by transverse bolts 17 of the following frame 10. When the frame 10' is introduced into the firing chamber on the working side of the transport device by a first transporting means such as a hydraulic cylinder, and performs a forward movement in the direction of arrow 18, all of the carriages are entrained as engaged frames 10. This advancing movement within the firing chamber 1 is performed in a step-wise manner preferably such that the travel length of an advancing step corresponds to the travel length of a frame 10 so that at the downstream end of the firing chamber 1, a respective frame 10 is positioned that, as shown in the drawings, can be pivoted and removed in a downward direction at an angle of approximately 20° to 30°. This thus released frame 10, which has been freed of the material to be fired, is positioned onto the rail system 12 and is then transported at an increased velocity together with the holder 9 and the rods 7 to the upstream end of the firing chamber in the direction of arrow 19.

At this location, the frame 10 is lifted and positioned in a slanted position (at an angle of approximately 20° to 30°) pointing upwardly to be suspended from above on the transverse bolt 17. Once the frame 10 has assumed a horizontal position, the pulling-resistant connection is again produced, and ceramic products can be loaded onto the rods 7.

The frames 10 can be moved in the direction of arrow 19 by any second transporting means. Preferably, a circulating transporting device, i.e., a chain transporter, i.e., towing transporter, is used and operated in a step-wise manner. It should be operated in a stepwise manner in order to facilitate coupling and decoupling of the frames 10 to one another. The frames 20 are transported back by the second transporting means to the upstream end at a transport velocity that is greater than the transport velocity of the first transporting means in the firing chamber.

It is also important that a reversal of the frame 10 for the return transport is not performed. All the hooks 16 point in the same direction indicated by arrow 18.

Figure 3:
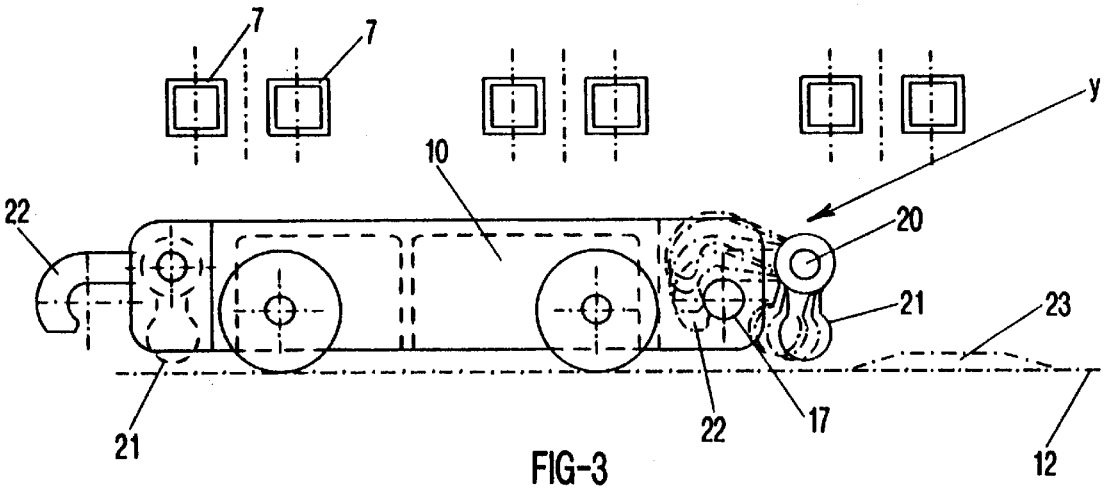
FIG. 3 shows a side view of a different embodiment in comparison to FIG. 2.
Figure 4:
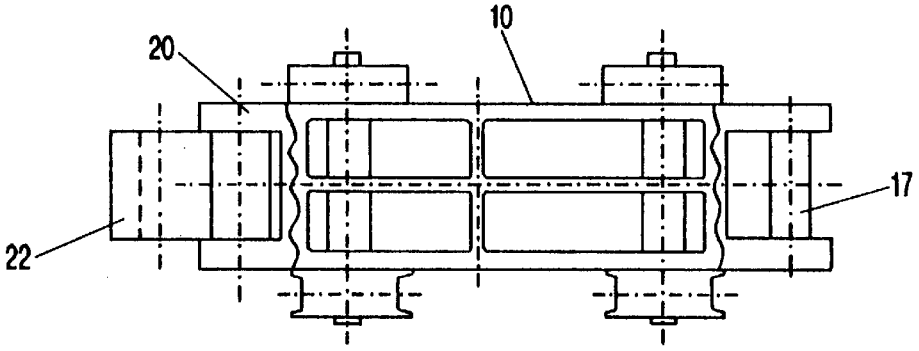
FIG. 4 shows a plan view onto the holder according to FIG. 3; and another embodiment of a detachable connection between adjacent arranged holders in a schematic representation.

In the embodiment according to FIG. 3, a fixedly connected hook 16 is replaced by a horizontally extending hook 22 which is pivotable about an axis 20 and provided with counter weights and pivot lever 21. In the end zone of the firing chamber 1 it contacts a cam 23 so that the hook 22 is lifted. In this hook position, the frame 10 to be decoupled can be removed without problems in the direction of arrow 18 without having to perform a tilting movement. It should be noted that, of course, the hook 22 represented at y belongs to the forwardly arranged, non-represented frame 10.

Figure 5:
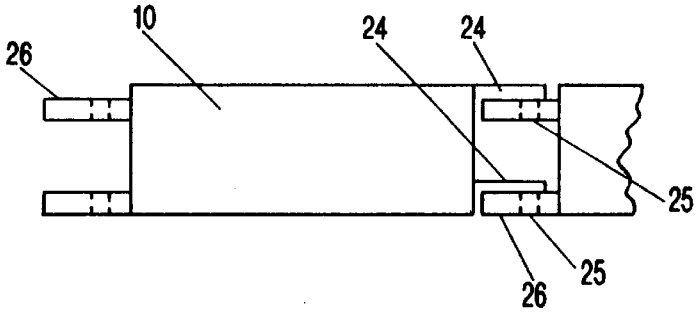
FIG. 5 shows a plan view of another embodiment of a detachable connection between adjacently arranged holders in a schematic representation.

The embodiment according to FIG. 5 shows different possibilities of coupling and decoupling the frames 10. For example, a projection 24 which is preferably arranged at opposed ends of the frame 10 is cooperating with the transversely extending pin 25 which engages a corresponding cutout of a projection 26 of a neighboring frame 10. The frame 10 to be coupled or decoupled can be engaged in a transverse movement relative to the frame 10 to be coupled or decoupled, so as to be moved into an active or inactive position.

The inventive embodiment of the firing chamber or kiln has great advantages, i.e., a substantially reduced number of holders 9 and rods 7 is sufficient to perform the firing operation without interruption.

It should be noted that the rods 7 can be arranged so as to be exchangeably positioned in varying locations, respectively, throughholes of the holders 9 effecting the slot sealing action.

It should furthermore be noted that the step-wise movement of the holders 9 can be selected as a function of the spacing between the rods 7 or as a function of the length of the ceramic product 15 to be fired, i.e., the travel length can be adjusted according to the spacing between the rods 7 or the length of the products 15.

The present invention is, of course, in no way restricted to the specific disclosure of the specification and drawings, but also encompasses any modifications within the scope of the appended claims.

What I claim is:

1. A kiln for ceramic products, said kiln comprising:

a firing chamber having sidewalls with opposed slots;

a transport device for transporting the ceramic products through said firing chamber in a transport direction;

said transport device comprising rods for supporting the ceramic products;

said rods extending perpendicularly to said transport direction and penetrating said opposed slots;

said transport device comprising a rail system and holders moveably guided on said rail system;

said transport device having a first transporting means and a second transporting means;

said rods having a first and a second end supported by a first set of holders and a second set of holders;

said first set of holders detachably connected to one another and said second set of holders detachably connected to one another, wherein said holders within said opposed slots are arranged directly adjacent to one another to tightly seal said slots;

wherein said firing chamber has an upstream end and a downstream end in said transport direction, wherein said first transporting means transports said holders through said firing chamber;

wherein said holders, with said rods supported thereon, are detached from one another at said downstream end and are individually transported back by said second transporting means to said upstream end at a transport velocity greater than a transport velocity of said first transporting means in said firing chamber and are reconnected to said holders present at said upstream end for transport through said firing chamber.

2. A kiln according to claim 1, wherein said holders are moved stepwise in advancing steps within said firing chamber.

3. A kiln according to claim 2, wherein a travel length of said advancing steps matches a length of said holders.

4. A kiln according to claim 2, wherein a travel length of said advancing steps matches a length of the ceramic product.

5. A kiln according to claim 2, wherein a travel length of said advancing steps matches a spacing between said rods.

6. A kiln according to claim 1, wherein said second transporting means is a towing transporter for transporting said holders from said downstream end back to said upstream end.

7. A kiln according to claim 6, wherein said towing transporter transports said holders in a stepwise manner.

8. A kiln according to claim 1, wherein said holders are connected to one another by a hook connection or a pin connection.

9. A kiln according to claim 8, wherein said hook connection is embodied such that said hook connection is coupled or decoupled when said holders are positioned in a slanted position relative to one another.

10. A kiln according to claim 9, wherein said hook connection comprises a hook pivotable about a pivot axis extending perpendicularly to said transport direction and wherein said holders are moved into said slanted position by contacting a stationary cam of said transport device.

11. A kiln according to claim 9, wherein in said slanted position said holders are positioned at an angle of 20–40° to one another.

12. A kiln according to claim 8, wherein said pin connection comprises a pin extending perpendicularly to said transport direction and wherein said pin connection is released by a relative movement of said holders in a direction transverse to said transport direction.

13. A kiln according to claim 1, wherein said transport device comprises carriages 10 to which said holders are connected and wherein said rods are positioned above said carriages during transport from said downstream end to said upstream end.

14. A kiln according to claim 1, wherein each one of said holders supports two of said rods.

* * * * *